US006164250A

United States Patent [19]

Bailey et al.

[11] Patent Number: 6,164,250

[45] Date of Patent: Dec. 26, 2000

[54] FREE PISTON INTERNAL COMBUSTION ENGINE WITH PISTON HEAD HAVING A RADIALLY MOVEABLE CAP

[75] Inventors: Brett M. Bailey, Peoria; John M. Sloma, Lacon, both of Ill.

[73] Assignee: Caterpillar Inc., Peoria, Ill.

[21] Appl. No.: 09/255,229

[22] Filed: Feb. 22, 1999

[51] Int. Cl.[7] ..... F02B 71/00

[52] U.S. Cl. ..... 123/46 R

[58] Field of Search ..... 123/46 R, 46 SC, 123/193.6

[56] References Cited

U.S. PATENT DOCUMENTS

| | | | |
|---|---|---|---|
| 4,020,804 | 5/1977 | Bailey | 123/46 R |
| 4,329,915 | 5/1982 | Schulz . | |
| 4,589,380 | 5/1986 | Coad | 123/46 R |
| 4,683,809 | 8/1987 | Taylor . | |
| 4,724,800 | 2/1988 | Wood | 123/59.7 |
| 4,986,234 | 1/1991 | Bell | 123/193 CP |
| 5,033,427 | 7/1991 | Kawamura et al. | 123/193.3 |
| 5,437,821 | 8/1995 | Diberardino et al. | 264/29.1 |
| 5,540,194 | 7/1996 | Adams . | |

FOREIGN PATENT DOCUMENTS

| | | |
|---|---|---|
| 3926791 A1 | 2/1991 | Germany . |
| WO 93/10345 | 5/1993 | WIPO . |

OTHER PUBLICATIONS

TU Dresden—publication date unknown—earliest date 1993—Dresden University in Germany.

*Primary Examiner*—Marguerite McMahon
*Assistant Examiner*—Jason Benton
*Attorney, Agent, or Firm*—Todd T. Taylor

[57] ABSTRACT

A free piston internal combustion engine includes a combustion cylinder having an inside surface. A piston which is reciprocally disposed within the combustion cylinder includes a piston head and a plunger rod. The plunger rod is attached to the piston head and has a longitudinal axis. The piston head includes a non-metallic cap and a metallic skirt. The cap has a outside surface lying closely adjacent to and defining a bearing surface with the inside surface of the combustion cylinder. The cap is substantially immovably attached to the skirt in a direction parallel to the longitudinal axis of the plunger rod, and is movably attached to the skirt in a radial direction relative to the longitudinal axis of the plunger rod.

23 Claims, 3 Drawing Sheets

FREE PISTON INTERNAL COMBUSTION ENGINE WITH PISTON HEAD HAVING A RADIALLY MOVEABLE CAP

TECHNICAL FIELD

The present invention relates to free piston internal combustion engines, and, more particularly, to piston and cylinder configurations within such engines.

BACKGROUND ART

Free piston internal combustion engines include one or more pistons which are reciprocally disposed within corresponding combustion cylinders. However, the pistons are not interconnected with each other through the use of a crankshaft. Rather, each piston is typically rigidly connected with a plunger rod which is used to provide some type of work output. For example, the plunger rod may be used to provide electrical power output by inducing an electrical current, or fluid power output such as pneumatic or hydraulic power output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center (TDC) position.

Pistons used in free piston internal combustion engines typically include a piston head which is entirely constructed from a metallic material such as aluminum or steel. Metals such as aluminum and steel have a relatively high coefficient of thermal expansion. Thus, during operation of the free piston engine, the metallic piston head expands considerably in the radial direction toward the inside surface of the combustion cylinder. Each piston head used in the free piston engine is thus formed with an outside diameter which provides a considerable radial clearance with the inside surface of the combustion cylinder to accommodate the relatively large radial expansion during operation. To prevent blow-by of combustion products past the piston head during operation, the outside peripheral surface of the piston head is formed with one or more piston ring grooves which receive corresponding piston rings therein. The piston rings allow for radial thermal expansion and contraction of the piston head, while at the same time effectively preventing blow-by of combustion products past the piston head.

Although piston rings provide valuable functionality as indicated above, it would be desirable to eliminate the use of piston rings to reduce manufacturing and assembly costs.

Moreover, to prevent excessive wear between the piston rings and the inside surface of the combustion cylinder, it is necessary to lubricate the piston rings with a suitable lubricant. The lubrication system for lubricating the piston rings may require additional porting and/or other structure to effect proper lubrication, which in turn increases the size and complexity of the engine. Additionally, the lubricating oil may increase undesirable emissions from the engine.

Another problem with using conventional piston and cylinder arrangements including a metallic combustion cylinder and metallic piston head with piston rings is that suitable fluid cooling channels must be provided within the combustion cylinder to effect the proper cooling of the combustion cylinder and piston head. These cooling fluid channels again increase the size and complexity of the engine.

The present invention is directed to overcoming one or more of the problems as set forth above.

SUMMARY OF THE INVENTION

The present invention provides a free piston internal combustion engine with a piston head having a non-metallic cap and a metallic skirt which are connected together such that the cap is free to move in a radial direction relative to a longitudinal axis of the plunger rod, thereby accommodating concentricity misalignments between the piston head and plunger rod during use.

In one aspect of the invention, a free piston internal combustion engine includes a combustion cylinder having a substantially cylindrical inside surface. A piston which is reciprocally disposed within the combustion cylinder includes a piston head and a plunger rod. The plunger rod is attached to the piston head and has a longitudinal axis. The piston head includes a non-metallic cap and a metallic skirt. The cap has a substantially cylindrical outside surface lying closely adjacent to and defining a bearing surface with the inside surface of the combustion cylinder. The cap is substantially immovably attached to the skirt in a direction parallel to the longitudinal axis of the plunger rod, and is movably attached to the skirt in a radial direction relative to the longitudinal axis of the plunger rod.

An advantage of the present invention is that the piston head is mounted relative to the plunger rod to accommodate concentricity misalignments therebetween.

Another advantage is that radial loading on the piston head and plunger rod associated with concentricity misalignments are reduced or eliminated.

Another advantage is that radial operating tolerances between the piston head and inside surface of the combustion cylinder can be reduced or eliminated to prevent blow-by of combustion products without the use of piston ring grooves and piston rings.

Yet another advantage is that the absence of piston rings eliminates the need for lubricating oil and cooling fluid in the free piston engine, which in turn reduces the physical size of the engine and eliminates efficiency losses associated with such lubricating and cooling structure.

Still another advantage is that the portion of the piston head defining the bearing surface is constructed from a material having low friction, low thermal expansion and high temperature resistance properties.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
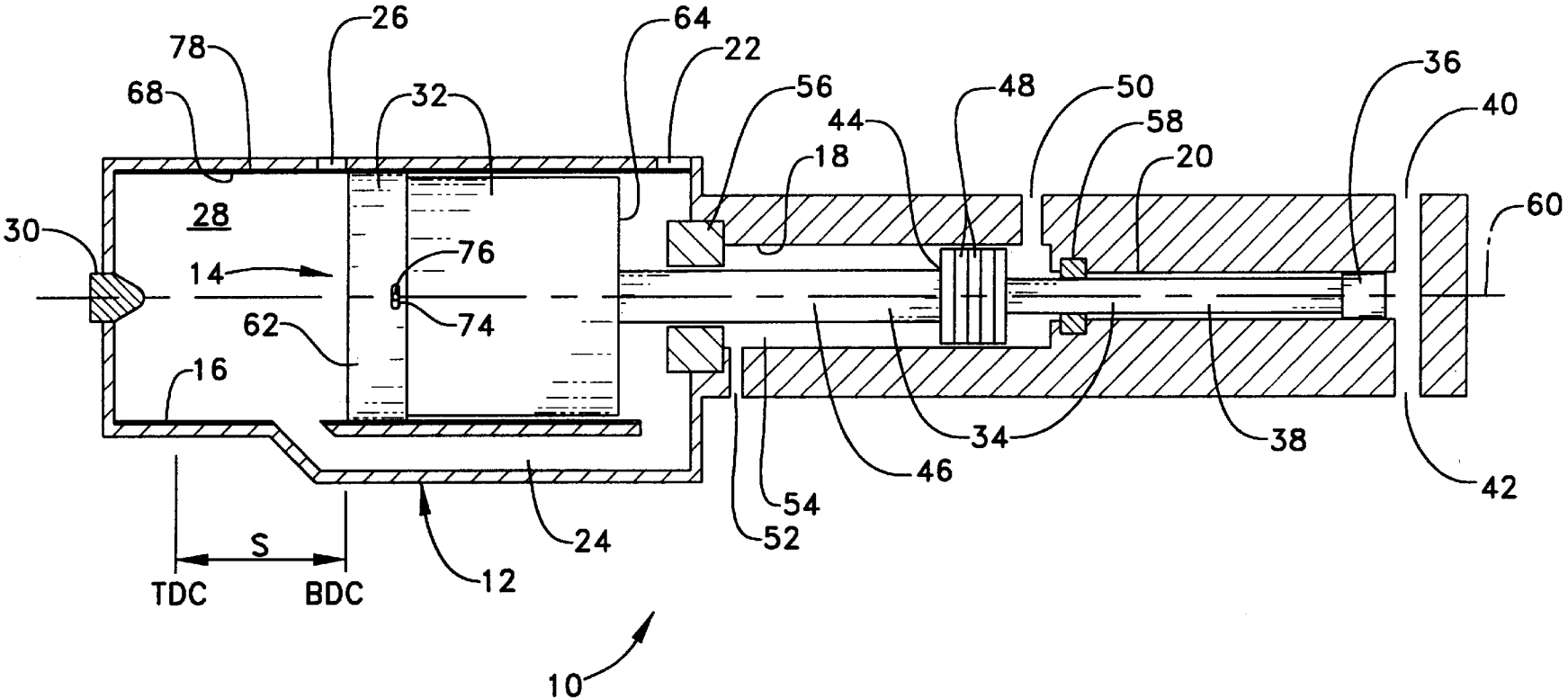
FIG. 1 is a simplified side, sectional view of a portion of a free piston internal combustion engine with an embodiment of a piston of the present invention disposed therein.

Referring now to the drawings, and more particularly to FIG. 1, there is shown a simplified side, sectional view of an embodiment of a portion of a free piston internal combustion engine 10 including a housing 12 and piston 14.

Housing 12 generally includes a combustion cylinder 16, compression cylinder 18 and hydraulic cylinder 20. Housing 12 also includes a combustion air inlet 22, air scavenging channel 24 and exhaust outlet 26 which are disposed in communication with a combustion chamber 28 within combustion cylinder 16. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 28 and generally includes a piston head 32 which is attached to a plunger rod 34. A plunger head 36 is attached to a smaller diameter portion 38 of plunger rod 34 at an end generally opposite from piston head 32. Hydraulic cylinder 20 is disposed in communication with each of an inlet port 40 and an outlet port 42 in housing 12. Reciprocating movement of plunger head 36 within hydraulic cylinder 20 causes hydraulic fluid to be drawn into hydraulic cylinder 20 through inlet port 40 from a source of hydraulic fluid, such as a low pressure hydraulic accumulator (not shown), on a compression stroke of piston 14; and causes pressurized hydraulic fluid to be discharged from outlet port 42 to a high pressure hydraulic accumulator (not shown) on a return stroke of piston 14.

A compression head 44 is disposed between piston head 32 and plunger head 36, and interconnects smaller diameter portion 38 with a larger diameter portion 46 of plunger rod 34. Reciprocating movement of piston head 32 between a BDC position and a TDC position, and vice versa, causes corresponding reciprocating motion of compression head 44 within compression cylinder 18. Compression head 44 includes a plurality of sequentially adjacent lands and valleys 48 which effectively seal with and reduce friction between compression head 44 and an inside surface of compression cylinder 18. Compression cylinder 18 is disposed in communication with fluid ports 50 and 52 generally at opposite ends thereof. Pressurized fluid which is transported into compression cylinder 18 on a side of compression head 44 adjacent to fluid port 50 causes piston 14 to move toward a TDC position during a compression stroke. Conversely, pressurized fluid may be transported through fluid port 52 into compression cylinder 18 in an annular space 54 surrounding larger diameter portion 46 to effect a return stroke of piston 14 at the initial start up or upon the occurrence of a misfire.

Combustion cylinder 16 is separated from compression cylinder 18 using an annular bearing/seal 56 which surrounds larger diameter portion 46 of plunger rod 34. Bearing/seal 56 allows sliding movement of larger diameter portion 46 therethrough, while at the same time supporting larger diameter portion 46 in a radial direction. Similarly, compression cylinder 18 is separated from hydraulic cylinder 20 using an annular bearing/seal 58. Bearing/seal 58 allows sliding movement of smaller diameter portion 38 of plunger rod 34, while at the same time radially supporting smaller diameter portion 38. Since plunger rod 34 is slidingly carried by the pair of annular bearing/seals 56 and 58, it will be appreciated that the longitudinal axis 60 of plunger rod 34 extends through the center of each of bearing/seals 56 and 58. Because of manufacturing tolerances, etc., it is possible that the longitudinal axis 60 of plunger rod 34 may not lie exactly concentric with the longitudinal axis (not numbered) of combustion cylinder 16. A piston head in a free piston engine therefore conventionally includes piston ring grooves and piston rings around the circumference thereof to accommodate concentric misalignments between the piston head and plunger rod. As will be described in more detail below, however, piston head 32 of the present invention accommodates concentric misalignments between plunger rod 34 and piston head 32 in a different manner which provides distinct advantages.

Figure 2:
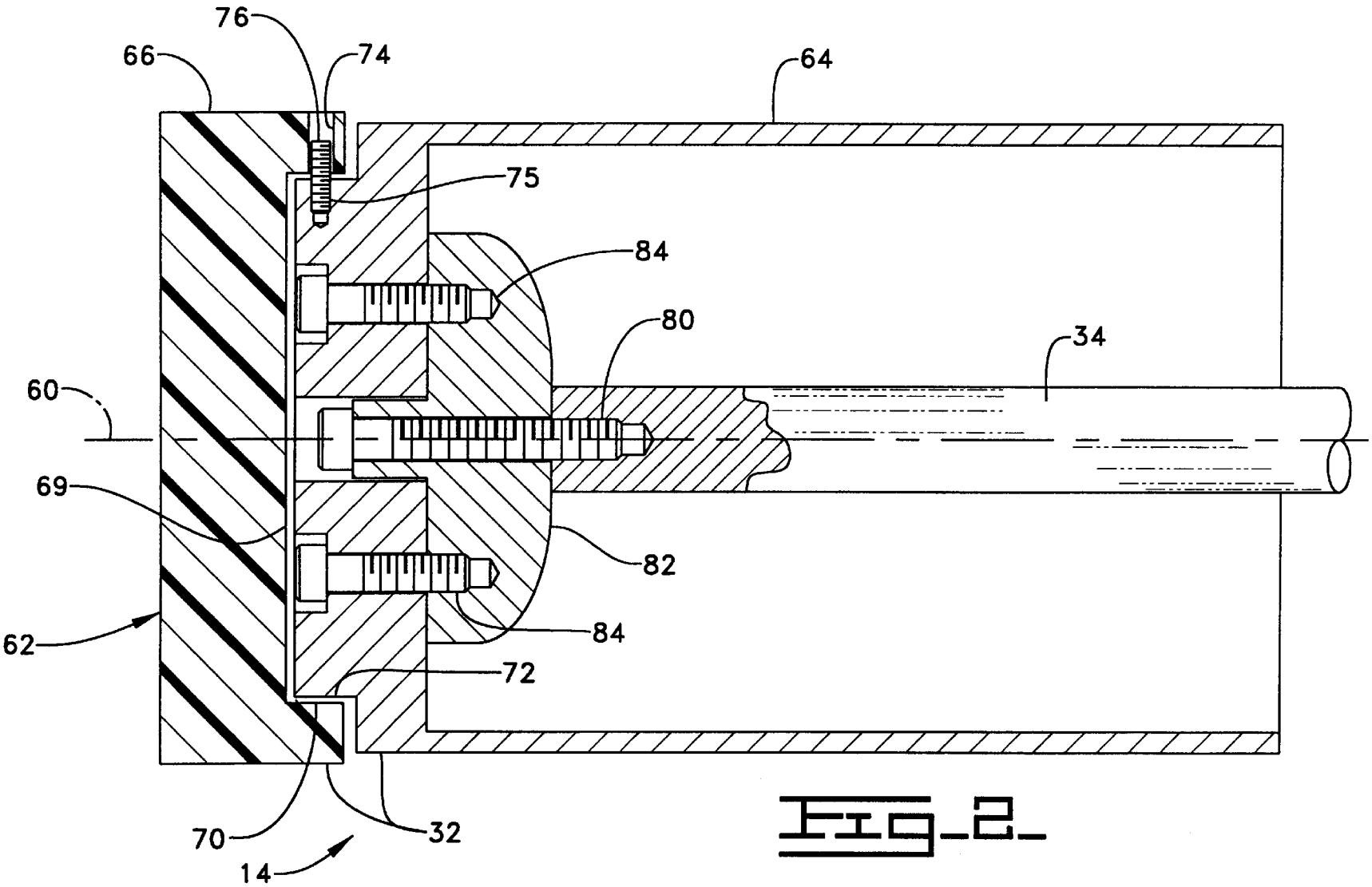
FIG. 2 is a side, sectional view of the piston shown in FIG. 1.

Referring now to FIG. 2, piston head 32 is shown in greater detail. Piston head 32 includes a non-metallic cap 62 which is connected to a metallic skirt 64. Cap 62 has a substantially cylindrical outside surface 66 with a diameter which is larger than the outside diameter of skirt 64. Outside surface 66 lies closely adjacent to and defines a bearing surface with an inside surface 68 (FIG. 1) of combustion cylinder 16. In the embodiment shown, outside surface 66 of cap 62 and inside surface 68 of combustion cylinder 16 have a radial operating clearance therebetween of between approximately 0.000 and 0.002 inch, preferably between approximately 0.000 and 0.001 inch, and more preferably approximately 0.000 inch. The term "radial operating clearance", as used herein, means the radial clearance between outside surface 66 of cap 62 and inside surface 68 of combustion cylinder 16 when free piston engine 10 is under operating conditions. That is, the radial operating clearance is designed to be within the range as set forth herein when piston 12 and combustion cylinder 16 are at an operating temperature.

As shown in FIG. 2, outside surface 66 of cap 62 does not include any piston ring grooves therein, and accordingly does not carry any piston rings. To prevent excessive blowby of exhaust products during the return stroke of piston 12, and to prevent excessive wear between outside surface 66 of cap 62 and inside surface 68 of combustion cylinder 16, cap 62 is formed from a material having selected physical properties. More particularly, cap 62 is formed from a non-metallic material having a relatively low coefficient of thermal expansion, low coefficient of friction and high temperature resistance. Examples of such non-metallic materials which have been found to be suitable include composite materials and ceramic materials. In the embodiment shown, cap 62 is formed from a carbon-carbon composite material having carbon reinforcing fibers within a carbon matrix. The carbon matrix may include carbon powder within a suitable resin. The carbon reinforcing fibers may be randomly oriented chopped fibers or may be longer filaments which are either randomly oriented or oriented in one or more directions.

The non-metallic material from which cap 62 is constructed preferably has a coefficient of thermal expansion of between approximately 0.5 and 10 ppm/° C. In the embodiment shown, the carbon-carbon composite material from which cap 62 is constructed has a coefficient of thermal expansion of approximately 1 and 2 ppm/° C. Moreover, the non-metallic material from which cap 62 is constructed preferably has a coefficient of friction of between 0.01 and 0.15. In the embodiment shown, the carbon-carbon composite material from which cap 62 is constructed has a coefficient of friction of approximately 0.10. Additionally, the non-metallic material from which cap 62 is constructed preferably has a temperature resistance of up to between approximately 400?C and 2500?C. In the embodiment shown, the carbon-carbon composite material from which cap 62 is constructed has a temperature resistance up to approximately 500° C.

Skirt 64 is formed from a suitable metallic material, such as aluminum or steel. In the embodiment shown, skirt 64 is formed from aluminum. Since the coefficient of thermal expansion of metallic skirt 64 is larger than the coefficient of thermal expansion of cap 62, the outside diameter of skirt 64 when at a non-operating temperature is small enough so that the outside diameter of skirt 64 does not exceed the outside diameter of outside surface 66 when at an operating temperature. That is, skirt 64 is not intended to be a primary bearing surface with inside surface 68 of combustion cylinder 16. of course, some intermittent contact may occur between the outside diameter of skirt 64 and inside surface of 68; however, skirt 64 is not intended to be a primary bearing surface.

Cap 62 and skirt 64 are connected together such that cap 62 may move a limited extent in a radial direction relative to skirt 64. More particularly, cap 62 includes a recess 69 defining a stepped inner surface 70 with a diameter which is larger than an outside diameter of a shoulder 72 of skirt 64. In the embodiment shown, a radial clearance of between approximately 0.001 and 0.003 inch, and more preferably approximately 0.002 inch is formed between inner surface 70 and shoulder 72. A plurality of radially extending holes 74 (four holes in the embodiment shown) receive respective set screws 76 therein which are threadingly engaged with holes 75 in shoulder 72. The inside diameter of each hole 74 is larger than the outside diameter of a corresponding set screw 76 so that set screws 76 retain cap 62 to skirt 64 while at the same allowing relative movement therebetween. Each hole 74 may be elongated in a direction corresponding to the circumference of cap 62 to allow radial movement of cap 62 in a direction which is generally perpendicular to a given set screw 76. Plunger rod 34 is carried by a pair of bearings/seals 56 and 58 along the axial length thereof which may not perfectly align with the longitudinal axis of combustion cylinder 16 because of manufacturing tolerances, etc. By allowing cap 62 to move in a radial direction relative to skirt 64, lateral loads on plunger rod 34 during reciprocation within free piston engine 10 are reduced or eliminated.

Combustion cylinder 16, in the embodiment shown, includes a liner 78 which defines inside surface 68. Liner 78 is formed from a non-metallic material having physical properties which are similar to the non-metallic material from which cap 62 is formed, as described above. In the embodiment shown, liner 78 is also formed from a carbon-carbon composite material with physical properties which are substantially the same as the carbon-carbon composite material from which cap 62 is formed. Since the carbon-carbon composite material from which each of outside surface 66 and inside surface 68 are formed has a relatively low coefficient of friction, wear between outside surface 66 and inside surface 68 is minimized. Moreover, since the carbon-carbon composite material from which each of outside surface 66 and inside surface 68 are formed has a relatively low coefficient of thermal expansion, the radial operating clearance therebetween can be maintained at a minimum distance (e.g., 0.000 inch), thereby preventing blow-by of combustion products during operation.

To assemble piston 12, bolt 80 is passed through mounting flange 82 and screwed into an end of plunger rod 34. Mounting flange 82 is then placed within metal skirt 64 and a plurality of bolts 84 are used to attach skirt 64 with mounting flange 30. Cap 62 is then placed over the end of skirt 64 and the plurality of set screws 76 are passed through the corresponding holes 74 in cap 62 and screwed into shoulder 72 of skirt 64. Piston 12 may then be installed within free piston engine 10.

Figure 3:
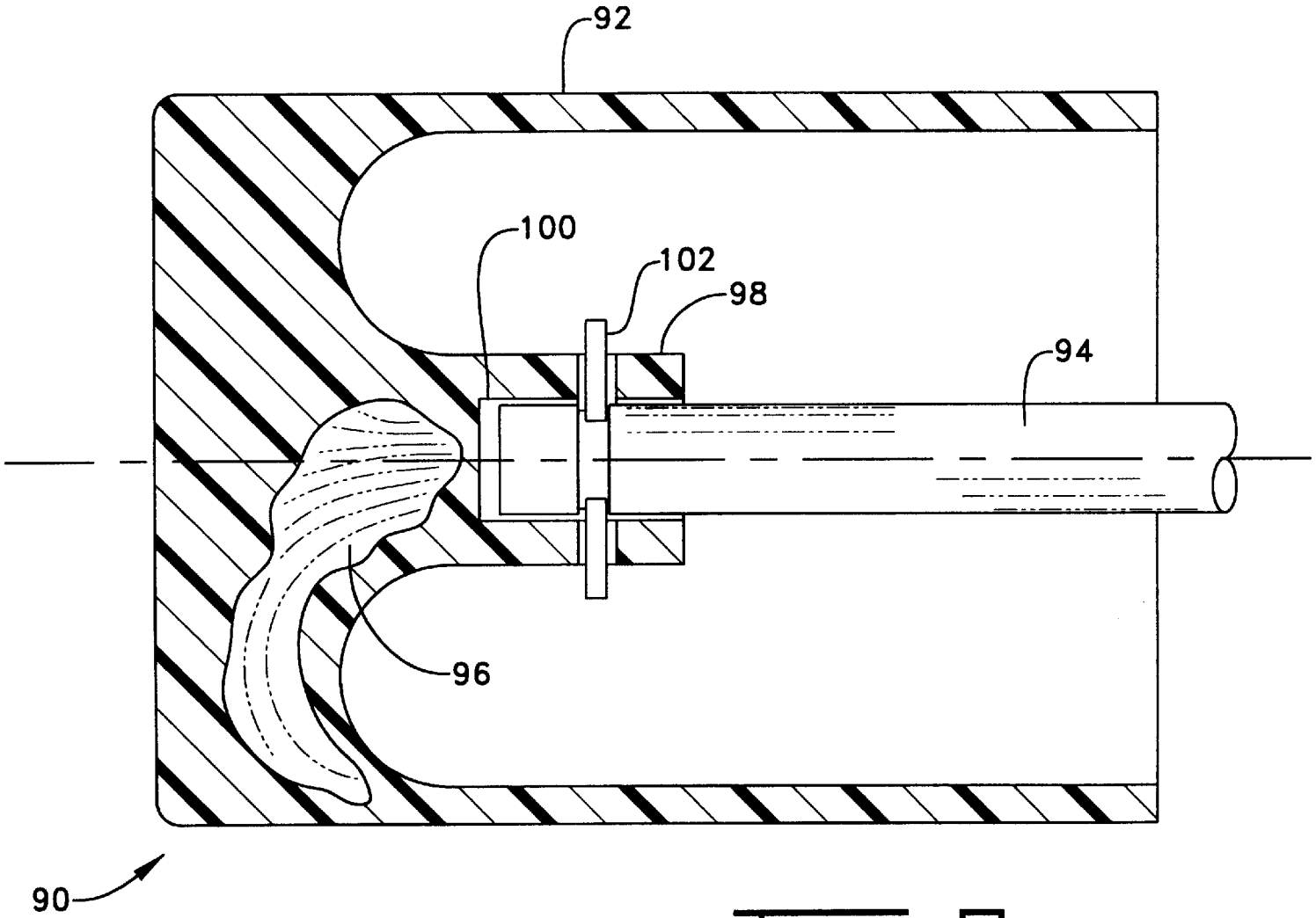
FIG. 3 is a side, sectional view of another embodiment of a piston of the present invention.

Referring now to FIG. 3, there is shown a side, sectional view of another embodiment of a piston 90 of the present invention, including a piston head 92 and plunger rod 94. Piston head 92 is formed entirely from a carbon-carbon composite material having carbon reinforcing fibers 96 which are oriented within piston head 92 generally as shown to provide strength to piston head 92 upon axial loading in either direction by plunger rod 94. Piston head 92 includes a hub 98 with an opening 100 having an inside diameter which is larger than an outside diameter of plunger rod 94 to thereby provide a desired radial operating clearance therebetween. A snap ring 102 attaches hub 98 to plunger rod 94, while at the same time allowing relative radial movement therebetween.

In the embodiments shown in the drawings and described above, piston heads 32 and 92 each include a generally flat face on the side facing combustion chamber 28. However, it is to be appreciated that the shape of the face disposed adjacent to combustion chamber 28 may vary, dependent upon the specific application.

INDUSTRIAL APPLICABILITY

During use, a selected piston 14 or 90 is reciprocally disposed within combustion cylinder 16. The selected piston travels between a BDC position and a TDC position during a compression stroke, and between a TDC position and BDC position during a return stroke. Combustion air is introduced into combustion chamber 28 through combustion air inlet 22 and air scavenging channel 24. Fuel is controllably injected into combustion chamber 28 using a fuel injector 30. The non-metallic, carbon-carbon bearing surfaces defined by the outside bearing surface of the piston head and inside surface 68 of combustion cylinder 16 allow the piston to be used within combustion cylinder 16 without the use of piston ring grooves or piston rings. Concentric misalignments between the longitudinal axis of plunger rod 34 and combustion cylinder 16 are accommodated through the ability of at least a portion of the piston head to move in a radial direction during reciprocating movement.

The piston head is mounted relative to the plunger rod to accommodate concentricity misalignments therebetween. Radial loading on the piston head and plunger rod associated with concentricity misalignments are thereby reduced or eliminated. The absence of piston rings eliminates the need for lubricating oil and cooling fluid in the free piston engine, which in turn reduces the physical size of the engine and eliminates efficiency losses associated with such lubricating and cooling structure.

Other aspects, objects and advantages of this invention can be obtained from a study of the drawings, the disclosure and the appended claims.

What is claimed is:

1. A free piston internal combustion engine, comprising:

a combustion cylinder having an inside surface; and a piston reciprocally disposed within said combustion cylinder, said piston including a piston head and a plunger rod, said plunger rod attached to said piston head and having a longitudinal axis, said piston head including a non-metallic cap and a metallic skirt, said cap having an outside surface lying closely adjacent to and defining a bearing surface with said inside surface of said combustion cylinder, said cap being substantially immovably attached to said skirt in a direction parallel to said longitudinal axis of said plunger rod, and movably attached to said skirt in a radial direction relative to said longitudinal axis of said plunger rod.

2. The free piston internal combustion engine of claim 1, wherein said cap has a recess with a radially inwardly facing annular inner surface, said recess fitting over an end of said skirt with a radial operating clearance allowing said movement in said radial direction.

3. The free piston internal combustion engine of claim 2, wherein said skirt includes an annular shoulder disposed within said recess of said cap.

4. The free piston internal combustion engine of claim 3, wherein said cap includes a plurality of holes extending radially from said bearing surface to said inner surface of said recess, and said skirt includes a plurality of holes extending radially from said shoulder, and further comprising a plurality of fasteners, each said fastener disposed within a respective said hole in said cap and rigidly attached to a respective said hole in said shoulder.

5. The free piston internal combustion engine of claim 4, wherein each said fastener is threadingly attached to a respective said hole in said shoulder.

6. The free piston internal combustion engine of claim 4, wherein each said hole in said cap is elongated in a circumferential direction of said bearing surface.

7. The free piston internal combustion engine of claim 1, wherein said cap has an outside diameter which is larger than an outside diameter of said skirt.

8. The free piston internal combustion engine of claim 1, wherein said non-metallic material is selected from the group consisting of composite and ceramic materials.

9. The free piston internal combustion engine of claim 8, wherein said non-metallic material consists essentially of a carbon-carbon composite material having carbon reinforcing fibers within a carbon matrix.

10. The free piston internal combustion engine of claim 1, wherein said non-metallic material has a coefficient of thermal expansion of between 0.5 and 10 ppm/° C.

11. The free piston internal combustion engine of claim 10, wherein said non-metallic material has a coefficient of thermal expansion of between approximately 1 and 2 ppm/° C.

12. The free piston internal combustion engine of claim 1, wherein said non-metallic material has a coefficient of friction of between 0.01 and 0.15.

13. The free piston internal combustion engine of claim 12, wherein said non-metallic material has a coefficient of friction of approximately 0.10.

14. The free piston internal combustion engine of claim 1, wherein said non-metallic material has a temperature resistance up to between 400° C. and 2500° C.

15. The free piston internal combustion engine of claim 14, wherein said non-metallic material has a temperature resistance up to approximately 500° C.

16. The free piston internal combustion engine of claim 1, wherein said outside surface of said piston head and said inside surface of said combustion cylinder have a radial operating clearance therebetween of approximately between 0.000 and 0.002 inch.

17. The free piston internal combustion engine of claim 16, wherein said outside surface of said piston head and said inside surface of said combustion cylinder have a radial operating clearance therebetween of approximately 0.000 inch.

18. A free piston internal combustion engine, comprising:

a combustion cylinder having an inside surface; and a piston reciprocally disposed within said combustion cylinder, said piston including a piston head and a plunger rod having a longitudinal axis, said piston head having an outside surface lying closely adjacent to and defining a bearing surface with said inside surface of said combustion cylinder, said piston head and said plunger rod being interconnected together such that said piston head travels with said plunger rod during reciprocal movement of said piston within said combustion cylinder, and said piston head is free to move in a radial direction relative to said longitudinal axis of said plunger rod during said reciprocal movement.

19. The free piston internal combustion engine of claim 18, wherein said piston head includes a non-metallic cap and a metallic skirt, said cap having a recess with a radially inwardly facing annular inner surface, said recess fitting over an end of said skirt with a radial operating clearance allowing said movement in said radial direction.

20. The free piston internal combustion engine of claim 19, wherein said skirt includes an annular shoulder disposed within said recess of said cap.

21. The free piston internal combustion engine of claim 20, wherein said cap includes a plurality of holes extending radially from said bearing surface to said inner surface of said recess, and said skirt includes a plurality of holes extending radially from said shoulder, and further comprising a plurality of fasteners, each said fastener disposed within a respective said hole in said cap and rigidly attached to a respective said hole in said shoulder.

22. The free piston internal combustion engine of claim 21, wherein each said fastener is threadingly attached to a respective said hole in said shoulder.

23. The free piston internal combustion engine of claim 21, wherein each said hole in said cap is elongated in a circumferential direction of said bearing surface.

* * * * *